US009699545B1

(12) United States Patent
Jain et al.

(10) Patent No.: US 9,699,545 B1
(45) Date of Patent: Jul. 4, 2017

(54) LOW-POWER METHOD AND CIRCUITRY OF DETERMINING HEADPHONE TYPE AND MONITORING ACTIVITY

(71) Applicant: Marvell International Ltd., Hamilton (BM)

(72) Inventors: Kapil Jain, Santa Clara, CA (US); Sriharsha Annadore, San Jose, CA (US)

(73) Assignee: Marvell International Ltd., Hamilton (BM)

( * ) Notice: Subject to any disclaimer, the term of this patent is extended or adjusted under 35 U.S.C. 154(b) by 0 days.

(21) Appl. No.: 15/069,483

(22) Filed: Mar. 14, 2016

Related U.S. Application Data

(63) Continuation-in-part of application No. 14/478,893, filed on Sep. 5, 2014, now Pat. No. 9,313,595.

(60) Provisional application No. 61/875,282, filed on Sep. 9, 2013.

(51) Int. Cl.
*H04R 1/10* (2006.01)

(52) U.S. Cl.
CPC ..... *H04R 1/1041* (2013.01); *H04R 2420/09* (2013.01)

(58) Field of Classification Search
None
See application file for complete search history.

(56) References Cited

U.S. PATENT DOCUMENTS 9,313,595 B1 * 4/2016 Jain ..... H04R 29/00
2009/0010476 A1 * 1/2009 Pan ..... H04R 1/1033 381/382
2009/0296952 A1 * 12/2009 Pantfoerder ..... H04M 1/6058 381/74
2010/0075723 A1 * 3/2010 Min ..... H01R 24/58 455/569.1
2011/0128019 A1 * 6/2011 Saito ..... H04R 5/04 324/713
2012/0170776 A1 * 7/2012 Han ..... H04R 1/1041 381/150
2012/0263313 A1 * 10/2012 Yu ..... H01R 24/58 381/74
2013/0089216 A1 * 4/2013 Han ..... H04R 29/001 381/74
2013/0142350 A1 * 6/2013 Larsen ..... H04R 1/1041 381/74
2014/0064512 A1 * 3/2014 Yu ..... H01R 24/58 381/74
2015/0011259 A1 * 1/2015 Chirde ..... H04M 1/72519 455/557

* cited by examiner

*Primary Examiner* — Peter Vincent Agustin

(57) ABSTRACT

A method includes comparing a voltage level detected by a detection circuit to a set of threshold voltages to determine a type of a headphone, determining the headphone to be a first type when a first signal travels through the first path to ground, and determining the headphone to be a second type when a second signal travels through the second path. The detection circuit includes a first path, a second path, and a bias capacitor. The headphone of the second type includes a plug that has a microphone connection.

20 Claims, 15 Drawing Sheets

2-100A 2-100B 10-203

10-253

LOW-POWER METHOD AND CIRCUITRY OF DETERMINING HEADPHONE TYPE AND MONITORING ACTIVITY

CROSS REFERENCE TO RELATED APPLICATIONS

This application is a continuation-in-part of U.S. patent application Ser. No. 14/478,893, filed on Sep. 5, 2014, which claims the benefit of U.S. Provisional Application No. 61/875,282, filed on Sep. 9, 2013, which are incorporated by reference herein in their entirety.

BACKGROUND

Electronic devices may receive connector plugs for headphones into sockets. For example, when a connector plug of a headphone is inserted into a socket of an electronic device, audio signals may be transmitted from the socket to the headphone through electrical connections formed between the socket and plug.

An electronic device may receive plugs of various types of headphones into a socket, including stereo headphones with plugs having three connection regions (i.e., poles) and stereo headsets with plugs having four connection regions. The electronic device may automatically determine the type of a received headphone. However, when a user inserts the plug of the received headphone into the socket of the electronic device, the plug of the headphone may not be properly inserted, thereby resulting in an erroneous determination of the type of the headphone.

SUMMARY

In an embodiment, a method includes comparing a voltage level detected by a detection circuit to a set of threshold voltages to determine a type of a headphone, determining the headphone to be a first type when a first signal travels through the first path to ground, and determining the headphone to be a second type when a second signal travels through the second path. The headphone of the second type includes a plug that has a microphone connection. The detection circuit includes a first path, a second path, and a bias capacitor.

In an embodiment, a method includes detecting a first voltage by a detection circuit, determining a type of a headphone to be a first type or a second type based on the detected first voltage level, and detecting a second voltage by the detection circuit, when the headphone is determined as the first type. The headphone of the second type includes a plug that has a microphone connection.

In an embodiment, a system includes a detection circuit including a first path, a second path, and a bias capacitor, a processor, and a non-transitory computer readable medium having computer executable instructions stored thereon which, when executed by the processor, performs comparing a voltage level detected by the detection circuit to a set of threshold voltages to determine a type of a headphone, determining the headphone to be a first type when a first signal travels through the first path to ground, and determining the headphone to be a second type when a second signal travels through the second path. The headphone of the second type includes a plug that has a microphone connection.

DETAILED DESCRIPTION

Figure 1:
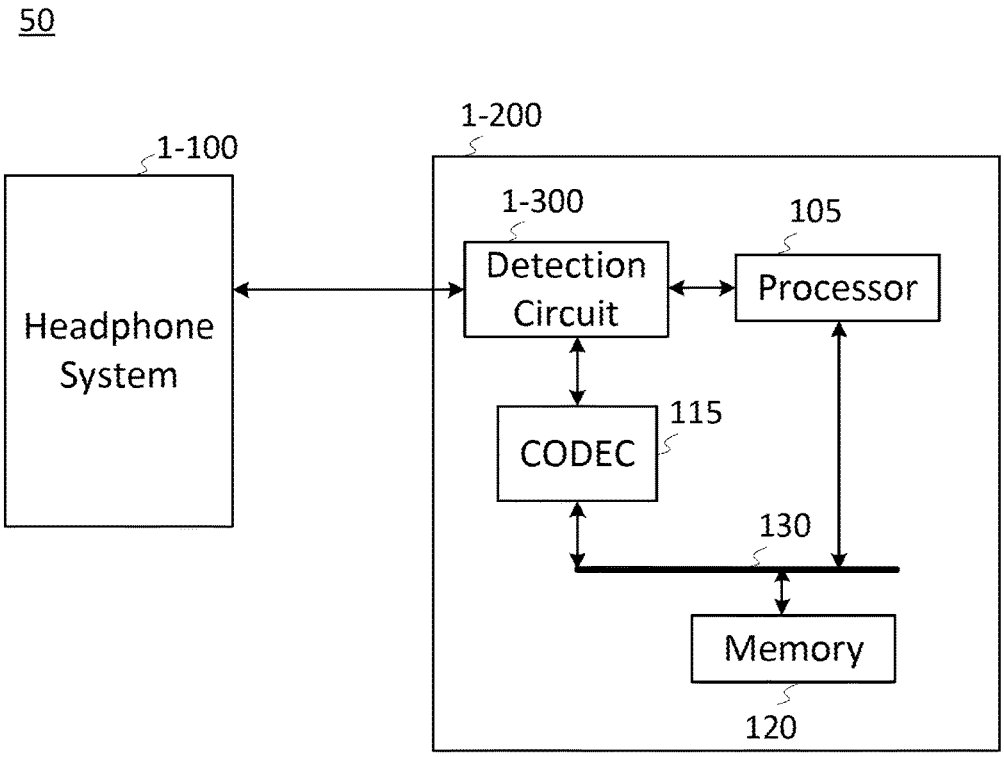
FIG. 1 is a block diagram of a headphone system and an electronic device according to an embodiment.

FIG. 1 shows an audio system 50 including a headphone system 1-100 and an electronic device 1-200 according to an embodiment. The electronic device 1-200 includes a detection circuit 1-300, a processor 105, a coder/decoder (CODEC) 115, a memory 120, and a bus 130.

The detection circuit 1-300 determines whether a plug of the headphone system 1-100 is inserted into a socket of the electronic device 1-200. The detection circuit 1-300 is used to determine a type of the headphone system 1-100 and monitor an operation of a switching device (or controllers) included in the headphone system 1-100.

In an embodiment, the detection circuit 1-300 transmits an output signal indicative of the type of the headphone system 1-100 to the processor 105. The processor 105 may interpret the signal to determine the type of the headphone system 1-100.

In an embodiment, the detection circuit 1-130 transmits an output signal indicative of an operation of a switching device included in the headphone system 1-100 to the processor 105. For example, the processor 105 may interpret the signal to determine which switching device has been turned on.

The CODEC 115 converts digital audio signals into analog signals to transmit the analog signals to the headphone system 1-100. The headphone system 1-100 converts the transmitted analog signals into sound.

The memory 120 is coupled to the CODEC 115 and the processor 105 through the bus 130. In an embodiment, the memory 120 includes cache, Flash, ROM, and/or RAM.

Figure 2A:
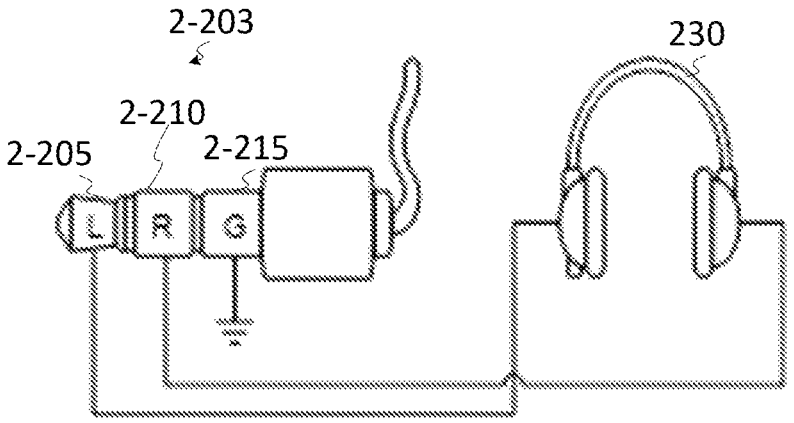
FIGS. 2A and 2B illustrate a 3-pole headphone system and a 4-pole headphone system, respectively, according to an embodiment.

FIG. 2A illustrates a 3-pole headphone system 2-100A suitable for use as the headphone system 1-100 of FIG. 1. The 3-pole headphone system 2-100A includes a headphone 230 and a plug 2-203 having a left audio signal connection 2-205, a right audio signal connection 2-210, and a ground connection 2-215. However, the order of the connections 2-205, 2-210, and 2-215 is not limited to the embodiment shown in FIG. 2A. For example, the left audio signal connection 2-205 and the right audio signal connection 2-210 may be interchanged.

Figure 2B:
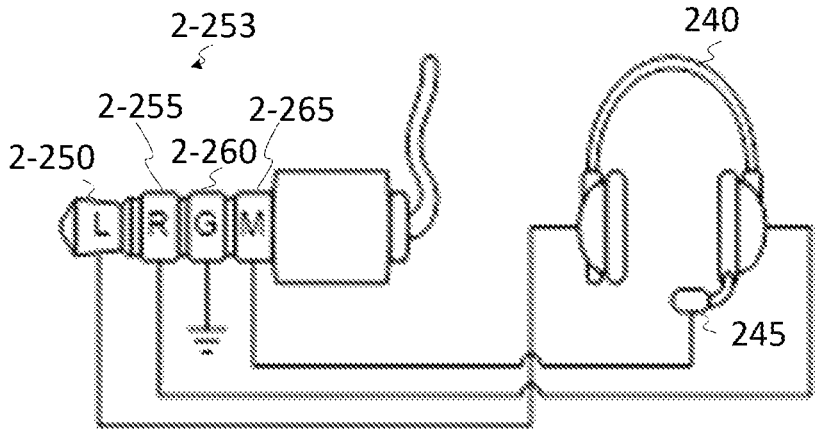

FIG. 2B illustrates a 4-pole headphone system (a stereo headset) 2-100B suitable for use as the headphone system 1-100 of FIG. 1. The 4-pole headphone system 2-100B includes a headphone with microphone 240 and a plug 2-253 having a left audio signal connection 2-250, a right audio signal connection 2-255, a ground connection 2-260, and a microphone connection 2-265. However, the order of the connections 2-250, 2-255, 2-260, and 2-265 is not limited to the embodiment shown in FIG. 2B.

In an embodiment, the 4-pole headphone system 2-100B includes a plurality of switching devices, each of which is used to trigger a predetermined action (e.g., increase or decrease volume, mute or unmute, etc.) Each switching device may be connected between the microphone connection 2-265 and the ground connection 2-260 in series with a resistor.

Figure 3:
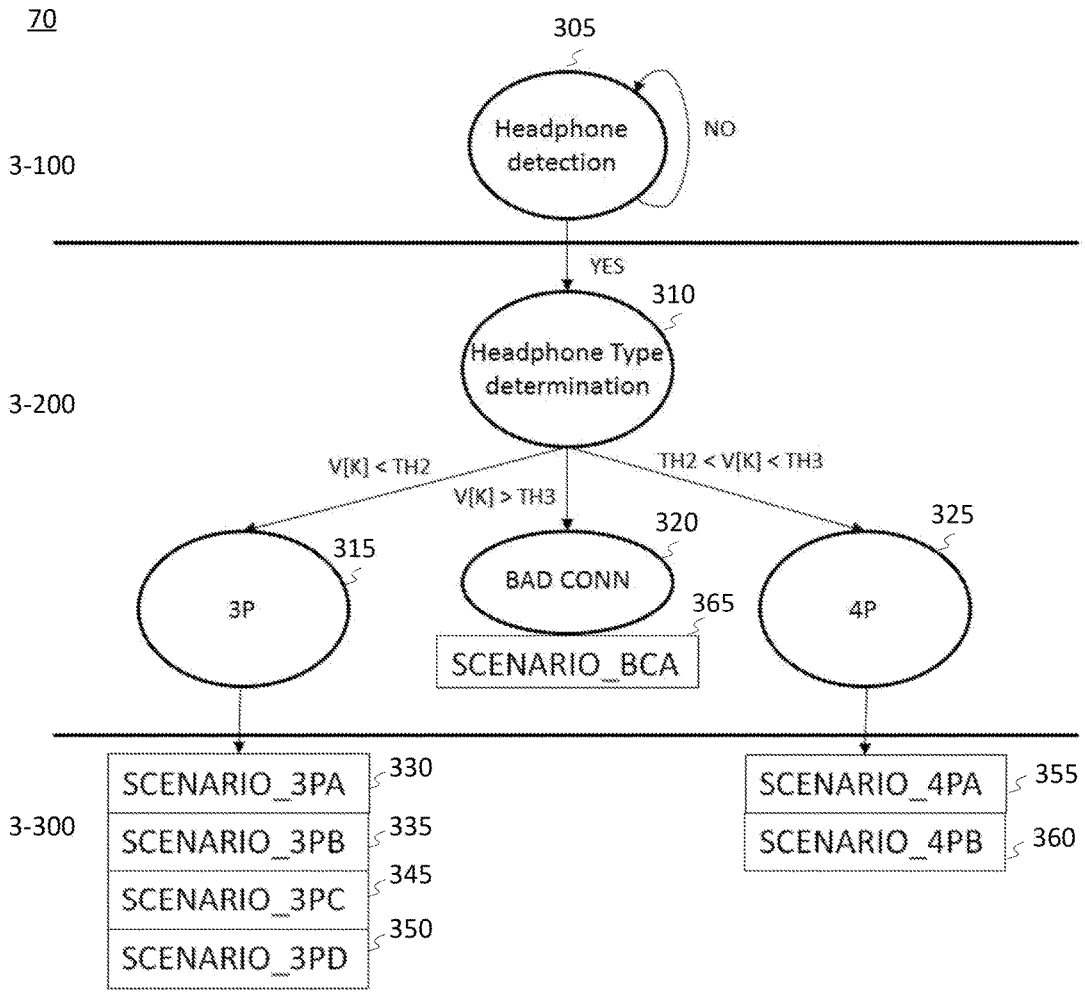
FIG. 3 is a diagram of a state machine for detecting a headphone, determining a type of the headphone, and monitoring activity on the headphone, according to an embodiment.

FIG. 3 illustrates a process 70 for detecting a headphone, determining a type of the headphone, and monitoring activity on the headphone, according to an embodiment, and a state machine used therein. In an embodiment, monitoring activity on a headphone includes confirming the type of headphone detected and determining which switching device (or controllers) included in the headphone has been turned on.

In the first stage 3-100, when an audio system 50 including the headphone system 1-100 and the electronic device 1-200 enters state 305, the detection circuit 1-300 of FIG. 1 operates to determine whether a plug of a headphone is inserted into a socket of the electronic device 1-200. For example, when a plug of the headphone is inserted into the socket, a normally closed switch in the socket can be mechanically opened to output a signal indicative of the insertion of the microphone. A person of ordinary skill in the art in light of the disclosures herein would understand other mechanical and/or electrical methods may be implemented to determine insertion of a plug into the socket of the electronic device 1-200.

In the second stage 3-200, the detection circuit 1-300 of FIG. 1 operates to determine the type of the headphone inserted during the first stage 3-100. In an embodiment, determination of the type of the inserted headphone is based on comparison of a voltage level detected by the detection circuit 1-300 to a set of threshold voltages, as will be described in more detail with reference to FIGS. 4A-4C. According to the comparison result, the audio system 50 enters into a 3P state 315, a 4P state 325, or a bad connection (BAD CONN) state 320, as shown in FIG. 3. The 3P state 315 indicates that the inserted headphone has been detected as being a 3-pole headphone type. The 4P state 325 indicates that the inserted headphone has been detected as being a 4-pole headphone type. The BAND CONN state 320 indicates a bad connection has been detected.

In the third stage 3-300, when the audio system 50 is in the 3P state 315, the audio system 50 may be configured in one of first through fifth scenarios 330 to 350 as shown in FIG. 3.

In the first scenario 330 (SCENARIO_3PA), the headphone determined as being the 3-pole headphone type is a properly inserted 3-pole headphone.

In the second scenario 335 (SCENARIO_3PB), the inserted headphone is actually a 4-pole headphone which has been determined to be the 3-pole headphone type due to improper insertion of the headphone plug into a socket. That is, the 4-pole headphone is inserted into the socket such that each connection of the 4-pole headphone contacts an incorrect terminal of the socket. For example, the 4-pole headphone is partially inserted such that the left audio signal connection, the right audio signal connection, and the ground connection of the 4-pole headphone contact to terminals corresponding to the right audio signal connection, the ground connection, and the microphone connection, respectively. In the third scenario 345 (SCENARIO_3PC), the inserted headphone is a 4-pole headphone which has been determined to be the 3-pole headphone type due to slow insertion of the headphone into a socket.

In the fourth scenario 350 (SCENARIO_ 3PD), the inserted headphone is a 4-pole headphone which has been determined to be the 3-pole headphone type due to an operation of a switching device included in the headphone system 1-100 of FIG. 1 during the insertion of the headphone.

Because the initial determination that the inserted headphone was a 3-pole headphone type is incorrect in the second through fourth scenarios 335, 345, and 350, the detection circuit 1-300 may operate to re-determine the headphone type, such as by repeatedly detecting the headphone type in order to conclusively determine a correct headphone type, as will be described in detail with reference to FIGS. 5A-5C and 6A-6C.

In the third stage 3-300, when the audio system is in the 4P state 325, the inserted headphone has been correctly detected as the 4-pole headphone type and the audio system 50 may be configured in one of a fifth and sixth scenarios 355 and 360. In the fifth scenario 355 (SCENARIO_4PA), a microphone of the inserted headphone is being used. In the sixth scenario 360 (SCENARIO_4PB), the microphone of the inserted headphone is not being used. In both the fifth and the sixth scenarios 355 and 360, a switching device included in the headphone system may be used, for instance, to change volume or mute, and accordingly the detection circuit 1-300 may repeatedly monitor operation of the switching device, as will be described in detail with reference to FIGS. 7A-7B.

Figure 4A:
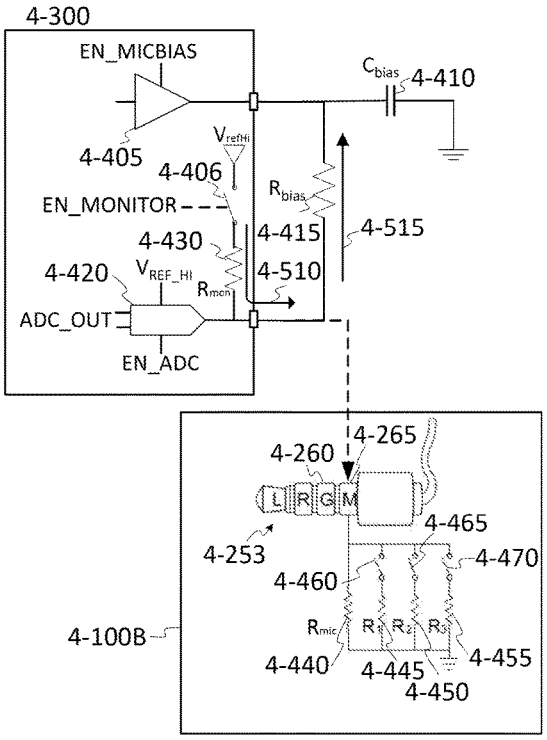
FIGS. 4A-4C illustrate initial determination of a headphone type according to an embodiment.

FIG. 4A is a circuit diagram of a portion of a detection circuit 4-300 when a plug 4-253 of a 4-pole headphone system 4-100B, similar to the 4-pole headphone system 2-100B shown in FIG. 2B, is inserted into a socket of an electronic device according to an embodiment. FIG. 4A shows circuit elements used for initial determination of a headphone type when the plug is inserted into a socket of the electronic device. The detection circuit 4-300 includes an analog-digital-converter (ADC) 4-420, a monitor circuit, and and a microphone bias (micbias) circuit having a buffer 4-405, a bias capacitor 4-410, a bias resistor 4-415.

The monitor circuit includes a first path 4-510 that has a monitor resistor 4-430 and a switching device (a monitor switch) 4-406. The monitor circuit is activated in response to an active monitor signal EN_MONITOR to couple a node at an input of the ADC 4-420 to a power source supplying a high reference voltage $V_{refHi}$. When the monitor circuit is activated, a current flows through the first path 4-510 and a second path 4-515 that has the bias resistor 4-415 to charge the bias capacitor 4-410 to a first reference voltage $V_{ref1}$. For example, the bias capacitor 4-410 is charged until the voltage level at a first end of the bias capacitor 4-410 coupled to the bias resistor 4-415 reaches about 0.2 V. A second end of the bias capacitor 4-410 is connected to ground. An input of the ADC 4-420 is connected to a microphone connection 4-265 of the 4-pole headphone 4-100B.

Within the 4-pole headphone system 4-100B, the microphone connection 4-265 is connected to a first terminal of a microphone resistor 4-440, a first terminal of a first switch 4-460, a first terminal of a second switch 4-465, and a first terminal of a third switch 4-470. Second terminals of the first through third switches 4-460, 4-465, and 4-475 are connected to first terminals of a first switch resistor $R_1$, second switch resistor $R_2$, and third switch resistor $R_3$, respectively. Second terminals of the microphone resistor 4-440, first switch resistor $R_1$, second switch resistor $R_2$, and third switch resistor $R_3$ are connected to ground, that is, to a ground connection 4-260 of the headphone 4-100B.

When first to third switching devices (or controllers) 4-460 to 4-470 are open, the input of the ADC 4-420 is connected to the bias resistor 4-415 and the microphone resistor 4-440, which together operate as a voltage divider. As a result, when the monitor circuit is turned off, the voltage level $V_{ADC_IN}$ at the node connected to the input of the ADC 4-420 is represented by Equation 1:

$$V_{ADC_IN} = \frac{V_{ref1} * R_{mic}}{R_{mic} + R_{bias}}. \quad \text{Equation 1}$$

The resistance value $R_{mic}$ of the microphone resistor 4-440 may vary with, for example, a headphone type or a manufacturer of the headphone. In an embodiment, the resistance value $R_{mic}$ of the microphone resistor 4-440 ranges from 1 kΩ to 10 kΩ. Where the resistance value $R_{mic}$ ranges from the minimum resistance value $R_{mic_min}$ to the maximum resistance value $R_{mic_max}$, the voltage level $V_{ADC_IN}$ at the node connected to the input of the ADC 4-420 is in the range between a second threshold voltage TH2 and a third threshold voltage TH3, as represented by Equation 2:

$$TH2 = \frac{V_{ref1} * R_{mic_min}}{R_{mic_min} + R_{bias}} \le V_{\mathrm{ADC_IN}} \le TH3 = \frac{V_{ref1} * R_{mic_max}}{R_{mic_max} + R_{bias}}. \quad \text{Equation 2}$$

The ADC 4-420 converts the voltage level of the ADC input $V_{ADC_IN}$ into a value of an ADC output ADC_OUT in response to an ADC activation signal EN_ADC. In an embodiment, the value of the ADC output ADC_OUT has a number of data bits corresponding to 8 to 10 bits. As described in Equation 2, when a 4-pole headphone having a microphone and switches is inserted without operating any of the switches, the voltage level of the ADC input $V_{ADC_IN}$ is in the range between the second and third threshold voltages TH2 and TH3. As a result, referring to FIG. 4C, when a value of an ADC output ADC_OUT is in a range between the values corresponding to the second and third threshold voltages TH2 and TH3, the inserted headphone type is initially determined as the 4-pole headphone type. In an embodiment, the output value of the ADC is compared with the values corresponding to the second and third threshold voltages TH2 and TH3 in the processor 105 of FIG. 1 to determine the headphone type.

Figure 4B:
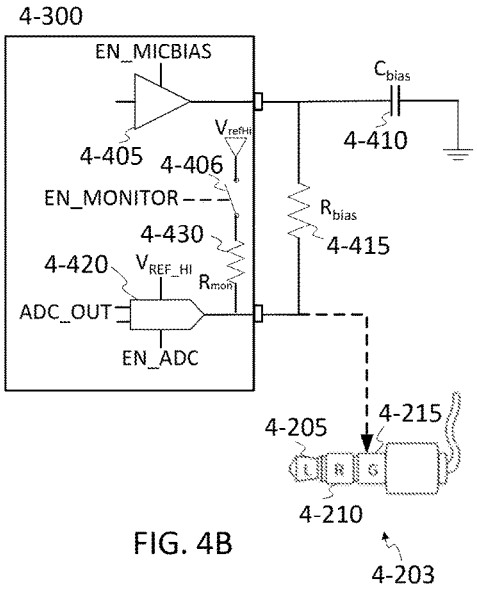

FIG. 4B is a circuit diagram of a portion of a detection circuit 4-300 when a plug of the 3-pole headphone system 2-100A of FIG. 2A is inserted into a socket of an electronic device according to an embodiment. FIG. 4B shows circuit elements used for initial determination of a type of a headphone when the headphone is inserted into a socket of the electronic device.

When a 3-pole headphone is inserted, a node connected to the input of the ADC 4-420 is connected to a ground connection 4-215 of a plug 4-203 of the inserted 3-pole headphone. As a result, a voltage level at the node connected to the input of the ADC 4-420 is lower than the second threshold voltage TH2. Thus, referring to FIG. 4C, if the value of the ADC output ADC_OUT is less the value corresponding to the second threshold voltage TH2, the inserted headphone type is initially determined as a 3-pole headphone.

When the value of the ADC output is greater than the third threshold voltage TH3, the audio system is determined as being in the BAD CONN state 320 of FIG. 3. As a result, the user of the audio system may be requested to remove and reinsert the headphone.

Figure 5A:
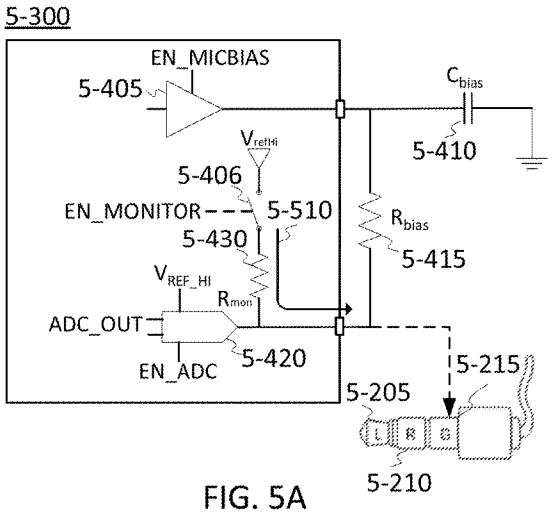
FIGS. 5A and 5B illustrate repetitive determination of a 3-pole headphone type according to an embodiment.
Figure 5B:
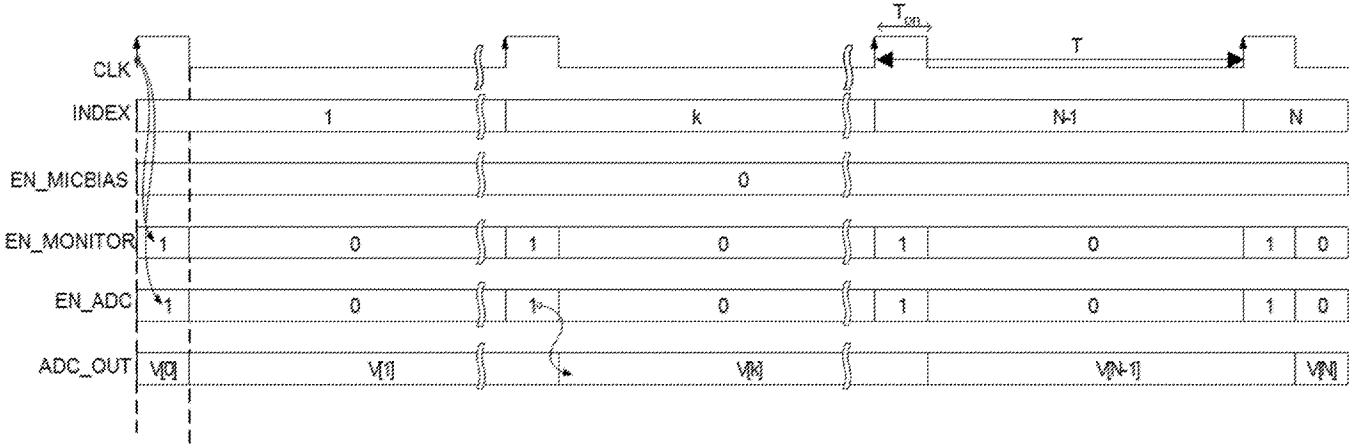

FIGS. 5A and 5B illustrate repetitive determination of a headphone type after the headphone is initially determined as a 3-pole headphone according to an embodiment. In this embodiment, the audio system including the headphone is in the first scenario 330 (SCENARIO_3PA) of FIG. 3, in which the headphone initially determined as being the 3-pole headphone is a 3-pole headphone.

FIG. 5A is a circuit diagram of a portion of a detection circuit 5-300 when a plug of the 3-pole headphone system 2-100A of FIG. 2A is inserted into an electronic device according to an embodiment. FIG. 5A shows circuit elements used for repetitive determination of a headphone type after the headphone is initially determined as a 3-pole headphone. The detection circuit 5-300 includes a monitor circuit, an ADC 5-420, and a micbias circuit.

The monitor circuit includes a first path 5-510 that has a monitor resistor 5-430 and a switching device (a monitor switch) 5-406. The monitor circuit is activated in response to an active monitor signal EN_MONITOR to couple a node at an input of the ADC 5-420 to a high reference voltage $V_{refHi}$.

The micbias circuit has a buffer 5-405, a bias capacitor 5-410, and a bias resistor 5-415. The monitor resistor 5-430 has a resistance value $R_{mon}$, which is substantially greater than a resistance value $R_{bias}$ of the bias resistor 5-415. In an embodiment, the resistance value $R_{mon}$ of the monitor resistor 5-430 is about ten times greater than the resistance value $R_{bias}$ of the bias resistor 5-415.

FIG. 5B illustrates a waveform of a clock signal CLK and values of an index INDEX corresponding to a number of detection cycles, a mic-bias signal EN_MICBIAS, a monitor signal EN_MONITOR, an ADC activation signal EN_ADC, and an output ADC_OUT of an ADC 5-420. A rising edge of the clock signal CLK corresponds to the start of each detection period T and causes the monitor signal EN_MONITOR and the ADC activation signal EN_ADC to have a logic high value (e.g., "1"). During the detection cycles, the mic-bias signal EN_MICBIAS continues to have a logic low value (e.g., "0") and the buffer 5-405 remains deactivated.

The clock signal CLK, the monitor signal EN_MONITOR, and the ADC activation signal EN_ADC each have the logic high value during a turn-on period Ton. The turn-on period Ton is shorter than the detection period T. In an embodiment, the turn-on period Ton is about 10% of the detection period T.

During the turn-on period Ton, the switching device 5-406 is closed and a current flows through the first path 5-510 to the ground connection 5-215. Thus, a voltage level at the node connected to the input of the ADC is lower than the second threshold voltage TH2 of FIG. 4C. As a result, where N is the maximum number of the detection cycles, a value V[k] of the ADC output ADC_OUT corresponding to the $k^{th}$ detection cycle satisfies the following Equation 3:

$$V[k] < TH2 = \frac{V_{ref1} * R_{mic_min}}{R_{mic_min} + R_{bias}} \text{ where } k = 1, 2, \ldots, N. \quad \text{Equation 3}$$

When Equation 3 is satisfied for all the detection cycles, the type of the headphone is conclusively determined as the 3-pole headphone.

In an embodiment, the micbias circuit including the buffer 5-405 is not used in repetitive determination of a headphone type after the headphone is initially determined as a 3-pole headphone. The total amount of currents in an embodiment of repeatedly detecting a headphone type is substantially less than that in a conventional method in which a micbias circuit is used to repeatedly detect a headphone type. As a result, the power consumption in an embodiment of the present disclosure is reduced compared to the power consumption using the conventional method.

Figure 6A:
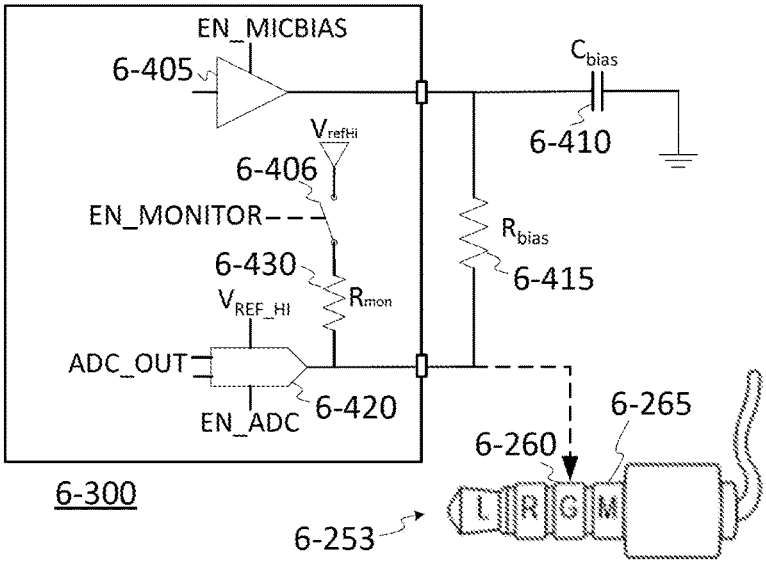
FIGS. 6A to 6C illustrate repetitive determination of a 4-pole headphone type according to an embodiment.

FIG. 6A illustrates an audio system including a headphone in the secondand third scenarios 335 (SCENARIO_3PB) and 345 (SCENARIO_3PC), in which the headphone initially determined as being a 3-pole headphone is actually a 4-pole headphone. That is, because the headphone is improperly inserted or slowly inserted into the electronic device, a node connected to an input of the ADC 6-420 during an initial determination of the headphone type is connected to a ground connection 6-260 of a plug as shown in FIG. 6A. Thus, a voltage level at the node connected to the input of the ADC 6-420 is less than the second threshold voltage TH2 of FIG. 4C, and the headphone is initially determined as a 3-pole headphone.

Figure 6B:
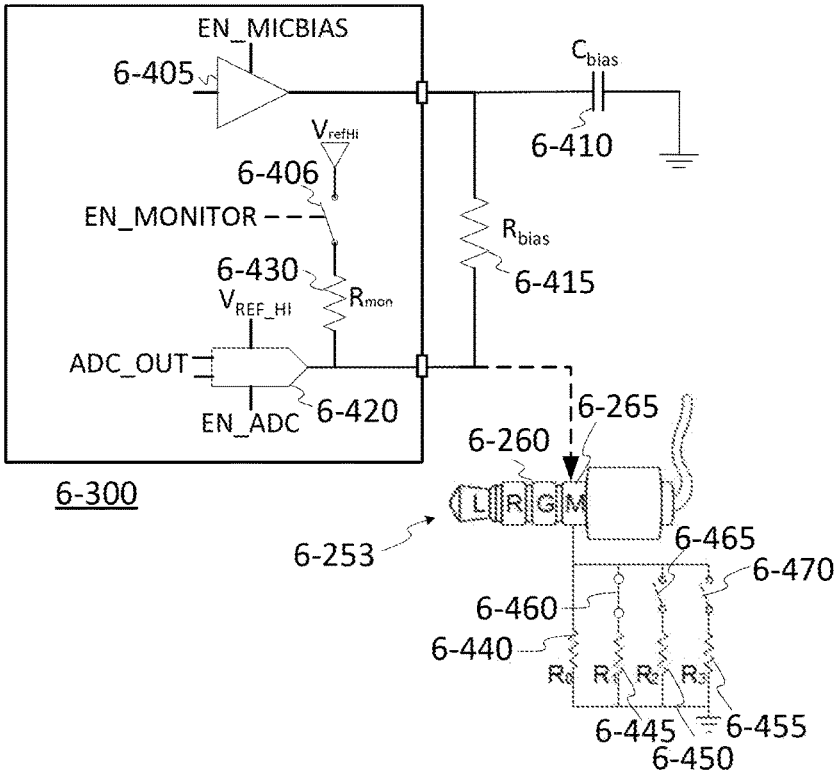

FIG. 6B illustrates an audio system including a headphone is in the fourth scenario 350 (SCENARIO_3PD), in which the headphone initially determined as being a 3-pole headphone is actually a 4-pole headphone. Under the fourth scenario 350 (SCENARIO_3PD), a first switching device 6-460 is turned on while the headphone is inserted as shown in FIG. 6B.

As a result, the node connected to the input of the ADC 6-420 during an initial determination of the headphone type is connected through a microphone connection 6-265 to a microphone resistor 6-440 and a first switch resistor 6-445. A resistance value $R_{mic}$ of the microphone resistor 6-440 is greater than respective resistance values $R_1$, $R_2$, and $R_3$ of first, second, and third switch resistors 6-445, 6-450, and 6-455. During the initial determination of the headphone type, the monitor circuit is turned on and a current flows through a monitor resistor 6-430 and a bias resistor 6-415 to charge the bias capacitor 6-410 to a first reference voltage $V_{ref1}$. In an embodiment, when the monitor circuit is turned off, since the resistance value $R_{mic}$ of the microphone resistor 6-440 is sufficiently large that most of the current flows through the first switch resistor 6-445, rather than through the microphone resistor 6-440A, a voltage level at the node connected to the input of the ADC 6-410 is represented by Equation 4:

$$V_{ADC_{IN},sw1} = \frac{V_{ref1} * R_1}{R_{bias} + R_1}. \quad \text{Equation 4}$$

Similarly, when a second switching device 6-465 is turned on during the initial determination of the headphone type, the voltage level at the node connected to the input of the ADC 6-410 is represented by Equation 5:

$$V_{ADC_{IN},sw2} = \frac{V_{ref1} * R_2}{R_{bias} + R_2}. \quad \text{Equation 5}$$

When a third switching device 6-470 is turned on during the initial determination of the headphone type, the voltage level at the node connected to the input of the ADC 6-410 is represented by Equation 6:

$$V_{ADC_{IN},sw3} = \frac{V_{ref1} * R_3}{R_{bias} + R_3}. \quad \text{Equation 6}$$

Figure 4C:
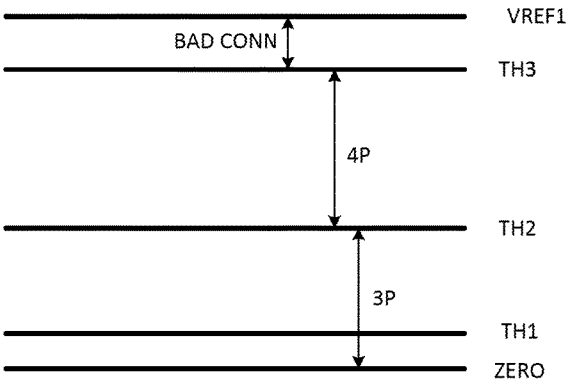

Defining the first threshold voltage TH1 as the maximum value of the voltage levels represented by Equations 4 to 6, the first threshold voltage TH1 is less than the second threshold voltage TH2 as shown in FIG. 4C. As a result, when any of the switching devices (or controllers) 4-460, 4-465, and 4-470 is turned on during the initial determination of the headphone type, the headphone is incorrectly determined as being a 3-pole headphone type, although the headphone is a 4-pole headphone.

Under the above-described second, third, and fourth scenarios 335 (SCENARIO_3PB), 345 (SCENARIO_3PC), and 350 (SCENARIO_3PD), the 4-pole headphone is initially determined as being the 3-pole headphone type. Thus, when a headphone is initially determined as a 3-pole headphone type, a re-determine of the type of the headphone is performed to determine whether the initial determination is correct, as will be described below with reference to FIG. 6C.

Figure 6C:
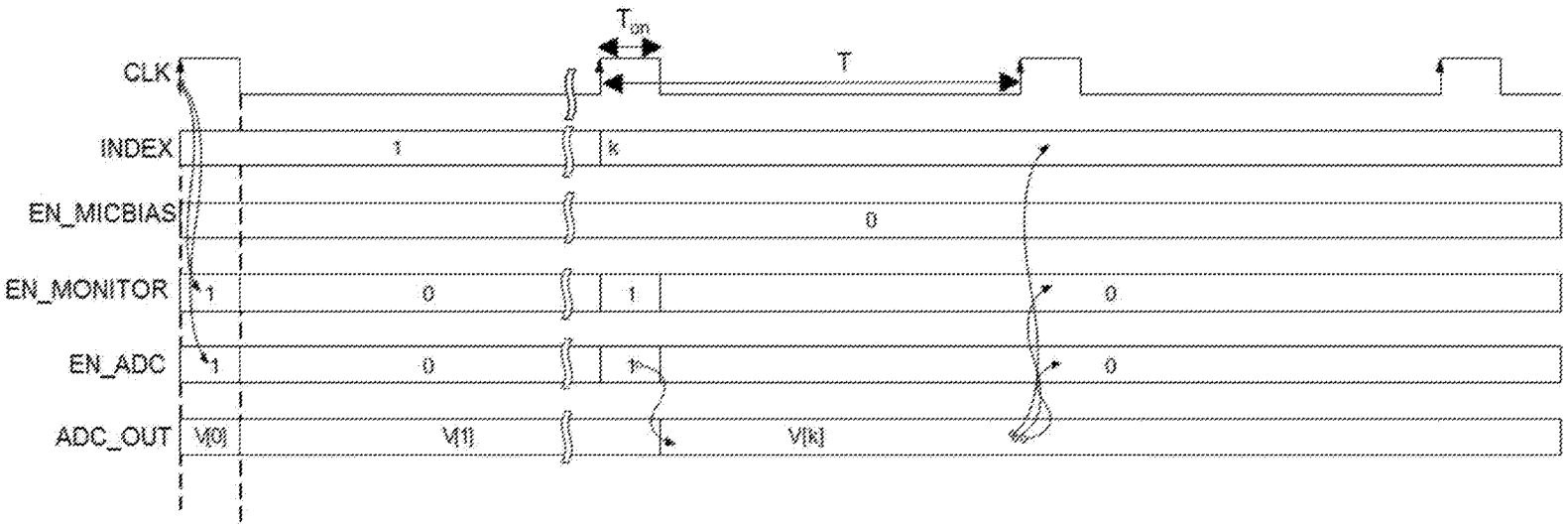

FIG. 6C illustrates a waveform of a clock signal CLK and values of an index INDEX corresponding to a number of detection cycles, a mic-bias signal EN_MICBIAS, a monitor signal EN_MONITOR, an ADC activation signal EN_ADC, and an output ADC_OUT of an ADC 6-420. A rising edge of the clock signal CLK corresponds to the start of each detection period T and causes the monitor signal EN_MONITOR and the ADC activation signal EN_ADC to have a logic high value (e.g., "1").

When the plug 6-253 is improperly inserted, slowly inserted, or one of the switches 6-460, 6-465, and 6-470 is pressed up to the $k-1^{th}$ detection cycle, the voltage level at the node connected to the input of the ADC is lower than the second threshold voltage TH2 of FIG. 4C. Thus, a value V[i] of the ADC output ADC_OUT corresponding to the $i^{th}$ detection cycle satisfies the following Equation 7:

$$V[i] < TH2 = \frac{V_{ref1} * R_{mic_min}}{R_{mic_min} + R_{bias}} \text{ where } i = 1, 2, \ldots, k-1. \quad \text{Equation 7}$$

When, at a time after the initial determination, the plug 6-253 is properly inserted and none of the switches 6-460, 6-465, and 6-470 are turned on before the $k^{th}$ detection cycle starts, the voltage level at the node connected to the input of the ADC becomes equal to or greater than the second threshold voltage TH2 of FIG. 4C at the $k^{th}$ detection cycle. That is, a value V[k] of the ADC output ADC_OUT corresponding to the $k^{th}$ detection cycle satisfies the following Equation 8:

$$V[k] \geq TH2 = \frac{V_{ref1} * R_{mic_min}}{R_{mic_{min}} + R_{bias}}. \quad \text{Equation 8}$$

Once the value V[k] of the ADC output ADC_OUT corresponding to the $k^{th}$ detection cycle satisfies the above equation, the type of the headphone is conclusively determined as the 4-pole headphone type and the values of the monitor signal EN_MONITOR and the ADC activation signal EN_ADC are set to have a logic low value (e.g., "0"). As a result, further detection is not performed as shown in FIG. 6C after the $k^{th}$ detection cycle.

In an embodiment, the micbias circuit including the buffer 6-405 is not used in repetitive determination of a headphone type after the headphone is initially determined as a 3-pole headphone. The total amount of currents in an embodiment of repeatedly detecting a headphone type is substantially less than that in a conventional method in which a micbias circuit is used to repeatedly detect a headphone type. As a result, the power consumption in an embodiment of the present disclosure is reduced compared to the power consumption using the conventional method.

Figure 7A:
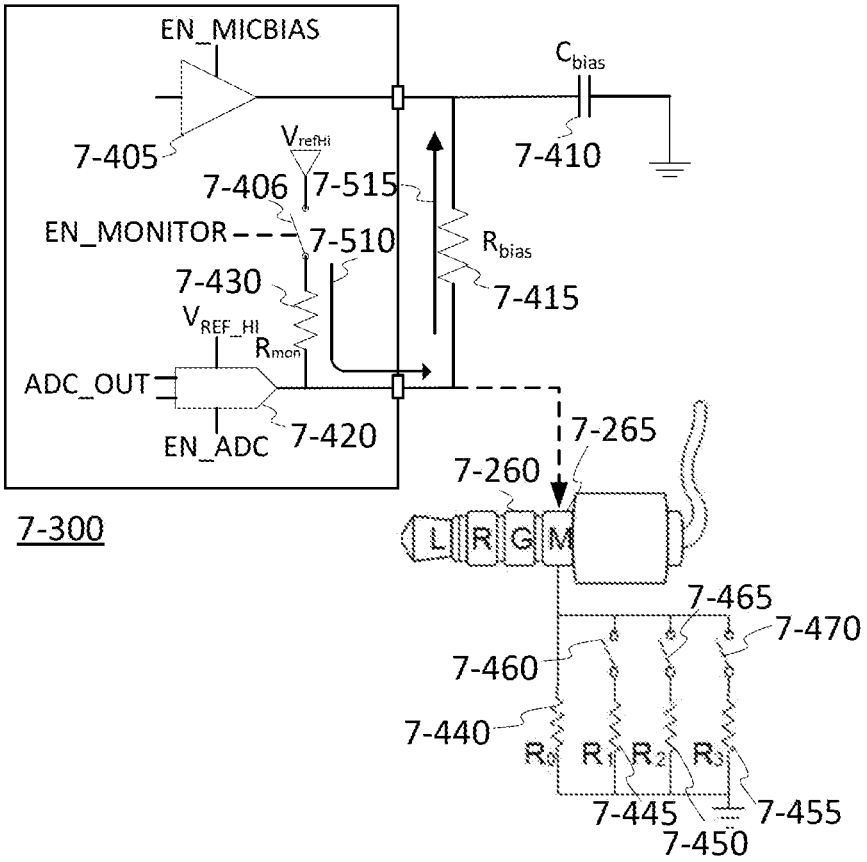
FIGS. 7A and 7B illustrate repetitive monitoring of a switch operation of the 4-pole headphone system shown in FIG. 2B according to an embodiment.

FIG. 7A illustrates an audio system including a headphone is in states 360 of FIG. 3 corresponding to the sixth scenario 355 (SCENARIO_4PB), in which the headphone is initially determined as the 4-pole headphone and a microphone is not used. However, a user may operate one of first, second, and third switching devices (or controllers) 7-460, 7-465, and 7-470 to trigger a predetermined action, for example, increasing/decreasing volume, mute/unmute, or the like. Thus, repetitive monitoring of operation of the first, second, and third switching devices 7-460, 7-465, and 7-470 is performed will be described below with reference to FIG. 7B.

Figure 7B:
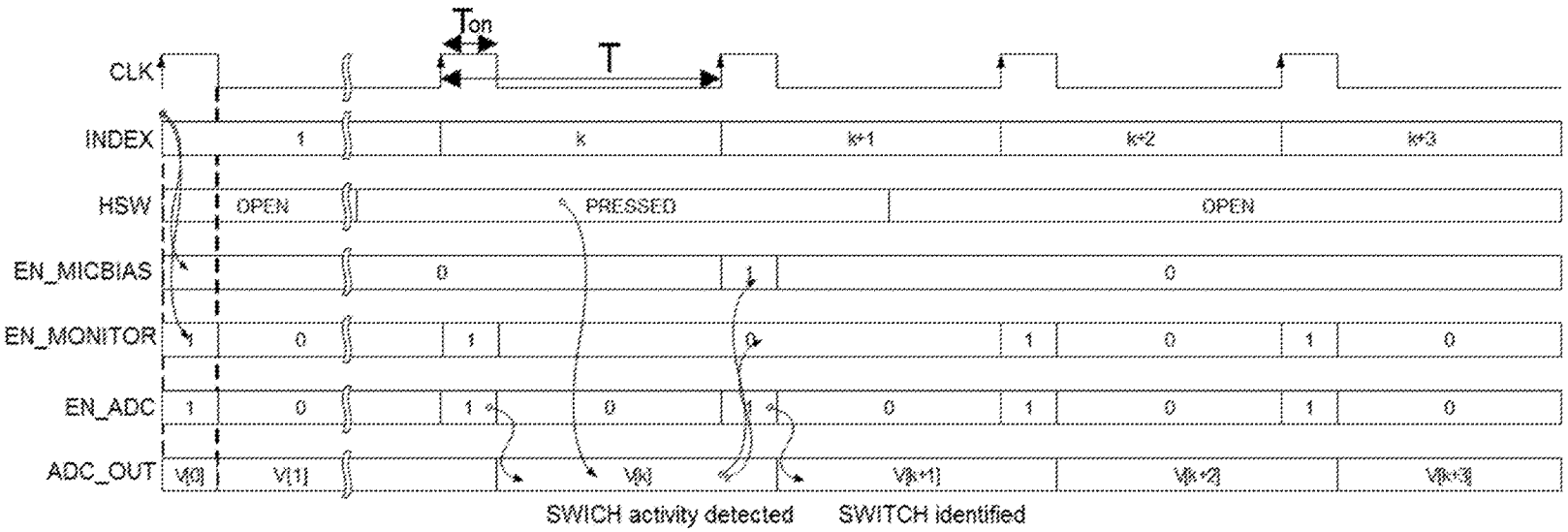

FIG. 7B illustrates a waveform of a clock signal CLK and values of an index INDEX corresponding to a number of monitoring cycles, a mic-bias signal EN_MICBIAS, a monitor signal EN_MONITOR, an ADC activation signal EN_ADC, and an output ADC_OUT of an ADC 7-420. A rising edge of the clock signal CLK corresponds to the start of each monitoring period T and causes the monitor signal EN_MONITOR and the ADC activation signal EN_ADC to have a logic high value (e.g., "1").

When none of the first, second, and third switching devices 7-460, 7-465, and 7-470 is turned on up to the $k-1^{th}$ monitoring cycle, a microphone resistor 7-440 is connected to a microphone connection 7-265 as shown in FIG. 7A. During a turn-on period Ton, a current (or signal) flows through a first path 7-510 including the monitor resistor 7-430 and a second path 7-515 including the bias resistor 7-415 to charge the bias capacitor 7-410 to a first reference voltage $V_{ref1}$. As a result, when the monitor circuit is turned off, a voltage level at the node connected to the input of the ADC 7-420 is equal to or greater than the second threshold voltage TH2 of FIG. 4C. That is, a value V[i] of the ADC output ADC_OUT corresponding to the $i^{th}$ monitoring cycle satisfies the following Equation 9:

$$V[i] \geq TH2 = \frac{V_{ref1} * R_{mic_min}}{R_{mic_min} + R_{bias}} \text{ where } \quad \text{Equation 9}$$

$$i = 1, 2, \ldots, k-1.$$

When a first switching device 7-460 is turned on before the $k^{th}$ monitoring cycle starts as shown in FIG. 7B, the microphone resistor 7-440 and the first switch resistor 7-445 are connected to the microphone connection 7-265. As a result, the voltage level at the node connected to the input of the ADC becomes less than the first threshold voltage TH1 of FIG. 4C. That is, a value V[k] of the ADC output ADC_OUT corresponding to the $k^{th}$ monitoring cycle satisfies the following Equation 10:

$$V[k] < TH1 = \frac{V_{ref1} * \max\{R_1, R_2, R_3\}}{R_{bias} + \max\{R_1, R_2, R_3\}}. \quad \text{Equation 10}$$

When the value V[k] of the ADC output ADC_OUT corresponding to the $k^{th}$ monitoring cycle satisfies the above equation, it is determined that one of the switches 7-460, 7-465, and 7-470 is pressed.

In an embodiment, the resolution of the ADC 7-420 may not permit the identification of which one of the first, second, and third switches 7-460, 7-465, and 7-470 was pressed in the $k^{th}$ monitoring cycle. To identify the turned on switch (e.g., the first switch 6-460 as shown in FIG. 6B), the rising edge of the clock signal CLK corresponding to the start of the $k+1^{th}$ monitoring cycle causes the mic-bias signal EN_MICBIAS and the ADC activation signal EN_ADC to have the logic high value and the monitor signal EN_MONITOR to have the logic low value. As a result, a current (or signal) flows to charge the bias capacitor 7-410 to a second reference voltage $V_{ref2}$ during the turn-on period Ton corresponding to the $k+1^{th}$ monitoring cycle. For example, the bias capacitor 7-410 is charged until the voltage level at a first end of the bias capacitor 7-410 coupled to the bias resistor 7-415 reaches about 1.8 V. Since the bias capacitor 7-410 is charged to the second reference voltage $V_{ref2}$ that has a level substantially higher than that of the first reference voltage $V_{ref1}$ a voltage level at the input of the ADC 7-420 when one of the first, second, and third switches 7-460, 7-465, and 7-470 is turned on is large enough to identify the pressed switch using the ADC 7-420. The pressed switch may be identified by comparing a value of an output ADC_OUT of the ADC 7-420 to a set of threshold values corresponding to the first, second, and third switches 7-460, 7-465, and 7-470. Once the turned on switch is identified, an appropriate action (e.g., increase or decrease volume, mute or unmute, etc.) is taken based on the identified switch.

Once the turned on switch is identified as described above, a rising edge of the clock signal CLK corresponding to the start of the $k+2^{th}$ monitoring cycle and subsequent monitoring cycles causes the mic-bias signal EN_MICBIAS to have the logic low value and the monitor signal EN_MONITOR and the ADC activation signal EN_ADC to have the logic high value, until one of the first, second, and third switches 7-460, 7-465, and 7-470 is turned on again. When one of the first, second, and third switches 7-460, 7-465, and 7-470 is turned on again, the process to monitor and identify the turned on switch is performed as described above.

In an embodiment, during the monitoring cycles except when a turned on switch is identified, the mic-bias signal EN_MICBIAS continues to have a logic low value (e.g., "0") and the buffer 7-405 remains deactivated. As a result, the power consumption in an embodiment of the present disclosure is reduced compared to the power consumption using a conventional method in which a micbias circuit is activated during substantially all the monitoring cycles to repeatedly monitor a switch operation.

Figure 8:
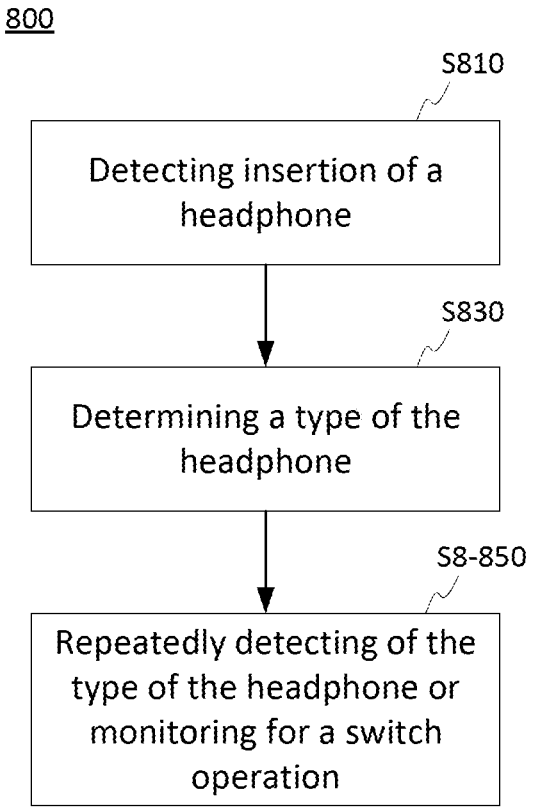
FIG. 8 is a flowchart of a process of determining a headphone type and monitoring a switch operation according to an embodiment.

FIG. 8 is a flowchart of a process of determining a headphone type and monitoring a switch operation according to an embodiment.

At S810, whether a headphone is inserted into an electronic device is determined. In an embodiment, a normally closed switch in a socket of the electronic device is mechanically opened when a plug of a headphone is inserted in the socket to output a signal indicating insertion of the plug.

At S830, a type of the inserted headphone is initially determined. For example, the inserted headphone is initially determined as a 3-pole headphone type or a 4-pole headphone type, or a bad connection state may be detected. In an embodiment, the type of the inserted headphone is determined based on comparison of a voltage level detected by a detection circuit of the electronic device to a set of threshold voltages.

At S8-850, determination of the headphone type or monitoring for a switch operation is performed repeatedly for a number of detection cycles. In an embodiment, the repetitive determination of the headphone type is performed when the headphone has been initially determined as a 3-pole headphone at S830. In an embodiment, the repetitive monitoring for a switch operation is performed when the headphone has been determined as a 4-pole headphone at 5380.

Figure 9A:
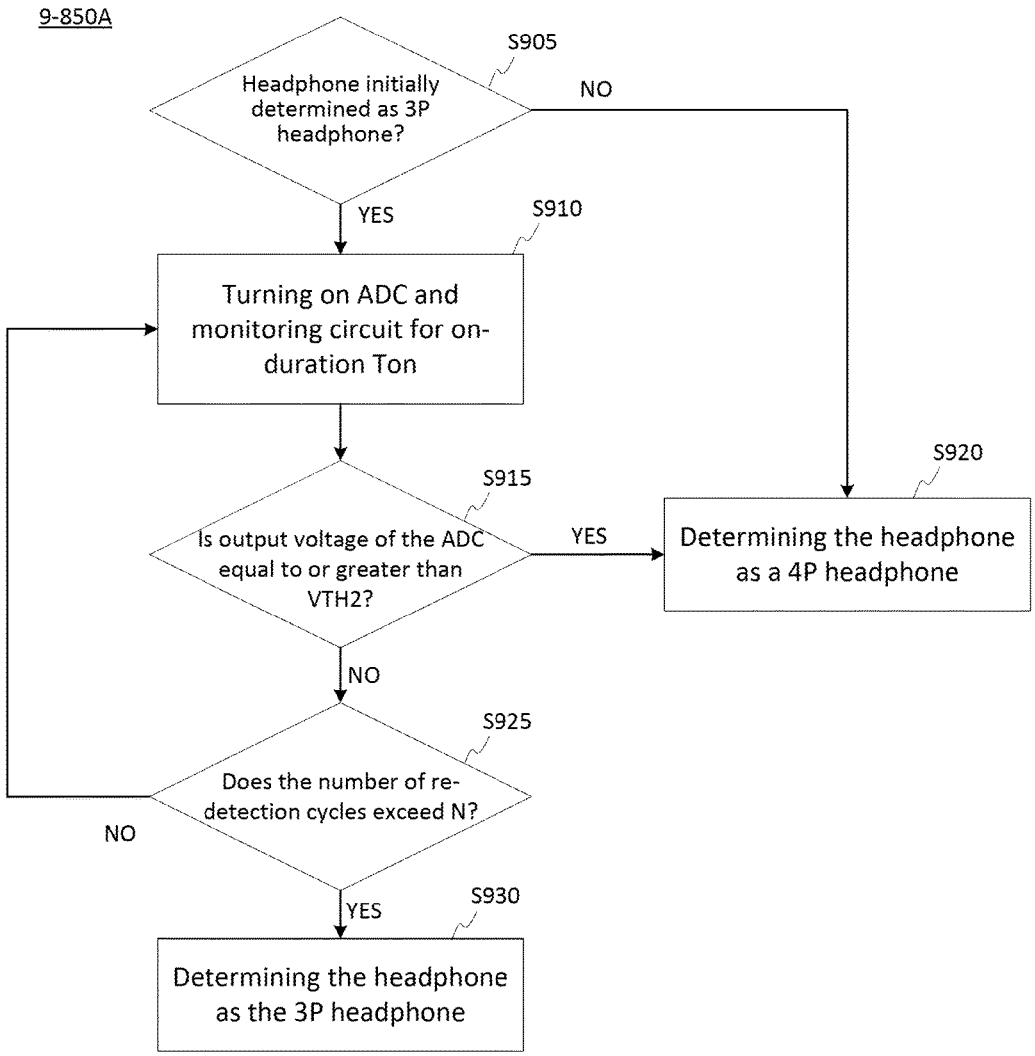
FIG. 9A illustrates a process of repetitive determination of a headphone type according to an embodiment.

FIG. 9A illustrates a process 9-850A of repetitive determination of a headphone type according to an embodiment.

At S905, whether a headphone inserted into an electronic device was initially determined as a 3-pole headphone type is determined. If so, then beginning at S910, the process 9-850 re-determines the type of the headphone. If not, at S920 the headphone is determined to be the 4-pole headphone type.

At S910, a monitor circuit and an ADC are activated during a turn-on period, which is shorter than a detection period T. In an embodiment, a rising edge of a clock signal corresponding to the start of each detection period T causes a monitor signal to have a logic high value and the monitor circuit is activated. When the inserted headphone is a 3-pole headphone, a current flows through a first path included in the monitor circuit to a ground connection of the 3-pole headphone during the turn-on period. When the inserted headphone is a 4-pole headphone, a current (or signal) flows through the first path and a second path included in the bias circuit to charge a bias capacitor to a first reference voltage.

At S915, a value of an ADC output at each detection cycle is compared to the second threshold voltage TH2 of FIG. 4C. If the value of the ADC output is equal to or greater than the second threshold voltage TH2, at S920 the headphone is conclusively determined as the 4-pole headphone type and no further detection cycle is performed.

If the value of the ADC output is less than the threshold voltage TH2, at S925 the electronic device checks whether the number of detection cycles is less than a predetermined maximum number N of detection cycles. When the number of detection cycles is less than the maximum number N of detection cycles, the method 9-850A proceeds to S910 to perform the next detection cycle. When the number of detection cycles is equal to the maximum number N of detection cycles, the headphone is conclusively determined as the 3-pole headphone type.

Figure 9B:
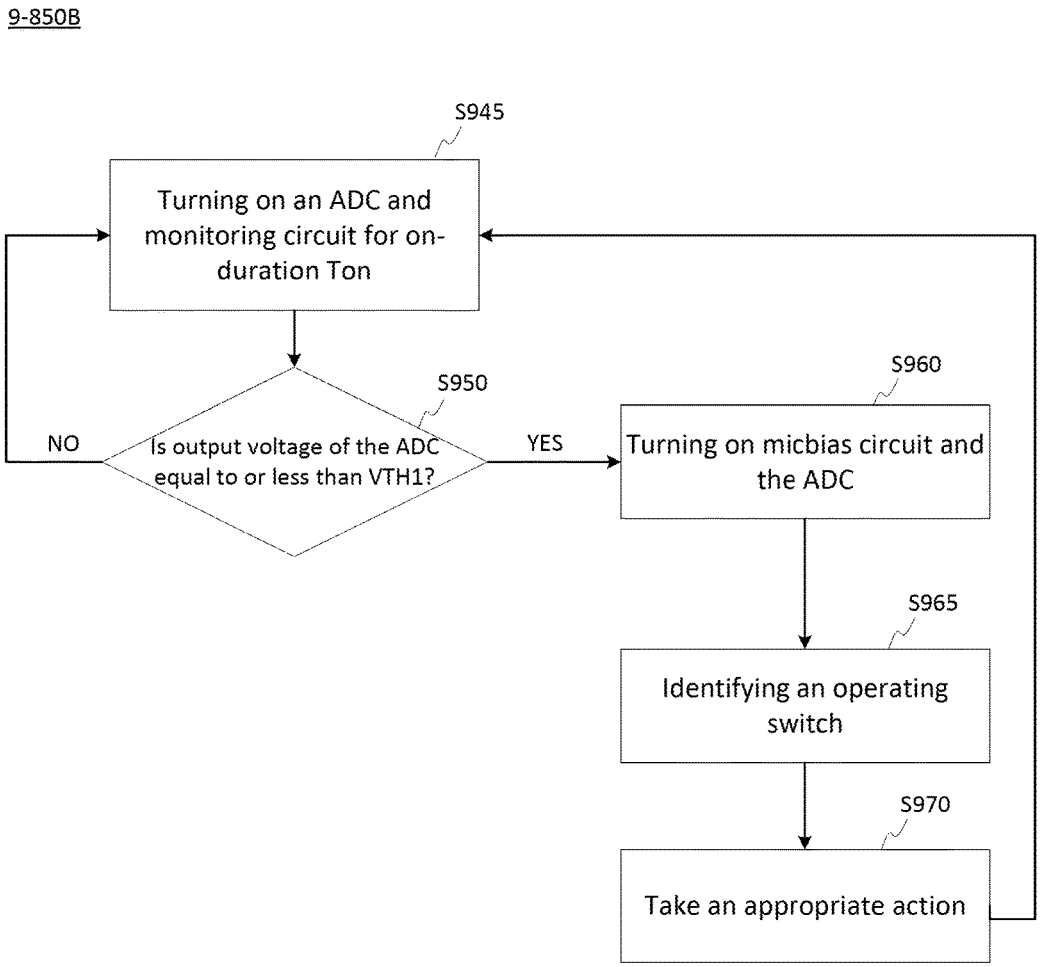
FIG. 9B illustrates a process of repetitive monitoring of a switch operation according to an embodiment

FIG. 9B illustrates a process 9-850B of repetitive monitoring of a switch operation according to an embodiment. Process 9-850B may be performed when a headphone has initially or conclusively determined to be the 4-pole headphone type.

At S945, a monitor circuit and an ADC are activated during a turn-on period Ton, which is shorter than a detection period T. In an embodiment, a rising edge of a clock signal corresponding to the start of each detection period T causes a monitor signal to have a logic high value and the monitor circuit is activated. As a result, a current (or signal) flows through the first path and the second path to charge the bias capacitor to the first reference voltage.

At S950, a value of an ADC output at each monitoring cycle is compared to a first threshold voltage TH1. If the value of the ADC output is equal to or less than the first threshold voltage TH1, it indicates that one of switching devices (or controllers) of the headphone is operating. Subsequently, at S960 a mic-bias signal is activated to cause a current (or signal) flows to charge the bias capacitor to a second reference voltage $V_{ref2}$ to identify an operating switch. Since the bias capacitor is charged to the second reference voltage $V_{ref2}$ that has a level substantially higher than that of the first reference voltage $V_{ref1}$, a voltage level at the input of the ADC when one of the switching devices is turned on is large enough to identify the pressed switch using the ADC. At S965, the operating switch is identified using the ADC. At S970, a predetermined action is taken based on the identified switch. Subsequently, the method 9-850B proceeds to S945 to continue monitoring an operating switch.

If the value of the ADC output is greater than the threshold voltage TH1, it indicates that none of the switching devices of the headphone is operating and the method 9-850B proceeds to S975. Thus, the method 9-850B proceeds to S945 to continue monitoring an operating switch.

Figure 10A:
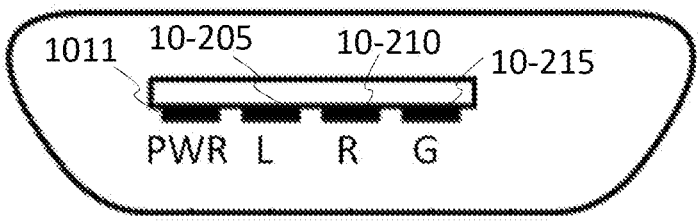
FIGS. 10A and 10B are cross-sectional views of first and second plugs included in first and second types of headphone systems, respectively, according to an embodiment.

In certain embodiments, the present headphone systems may use parallel connectors (or plugs), e.g., a Universal Serial Bus (USB), a lightning thunderbolt, or the like. FIG. 10A illustrates a cross-sectional view of a first plug 10-203 (or parallel connector) for a headphone system of an audio system (see, e.g., audio system 50 of FIG. 1) according to an embodiment. The first plug 10-203 has a power connection 1011, a left audio signal connection 10-205, a right audio signal connection 10-210, and a ground connection 10-215. However, the order and the configuration of the connections 1011, 10-205, 10-210, and 10-215 are not limited to the embodiment shown in FIG. 10A. In an embodiment, the left audio signal connection 10-205 and the right audio signal connection 10-210 may be interchanged. In an embodiment, the power connection 1011 and the left audio signal connection 10-205 are disposed on a first surface and the ground connection 10-215 and the right audio signal connection 10-210 are disposed on a second surface, such that the power connection 1011 and the left audio signal connection 10-205 face the ground connection 10-215 and the right audio signal connection 10-210, respectively.

Figure 10B:
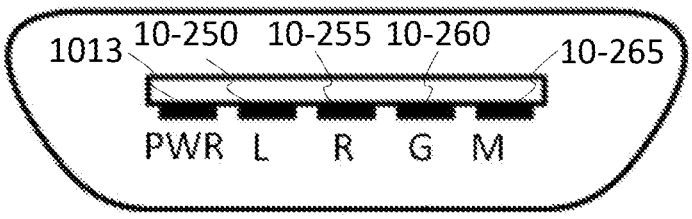

FIG. 10B illustrates a cross-sectional view of a second plug 10-253 (or parallel connector) for a headphone system of an audio system (see, e.g., audio system 50 of FIG. 1) according to another embodiment. The second plug 10-253 has a power connection 1013, a left audio signal connection 10-250, a right audio signal connection 10-255, a ground connection 10-260, and a microphone connection 10-265. However, the order and the configuration of the connections 1013, 10-250, 10-255, 10-260, and 10-265 are not limited to the embodiment shown in FIG. 10B.

Figure 11A:
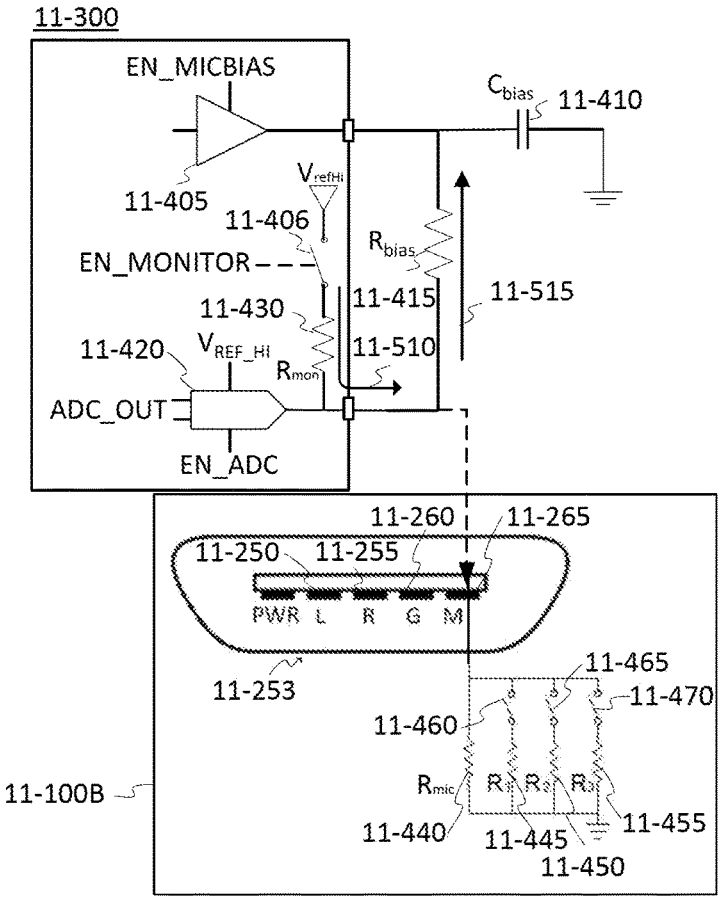
FIGS. 11A and 11B illustrate initial determination of a headphone type according to an embodiment.

FIG. 11A illustrates a circuit diagram of a portion of a detection circuit 11-300 when a second plug 11-253, similar to the second plug 10-253 of FIG. 10B, is inserted into a receptacle of an electronic device according to an embodiment. FIG. 11A illustrates circuit elements used for initial determination of a headphone type when the second plug 11-253 is inserted into the receptacle of the electronic device.

The detection circuit 11-300 is configured to operate with headphones having parallel connectors, e.g., a micro-Universal Serial Bus (USB) headphone, a standard USB headphone, a mini-USB headphone, a lightning thunderbolt, or the like. Like numbered reference numbers in FIG. 11A refer to similar components in FIG. 4A, and descriptions thereof are omitted in the interest of brevity.

Figure 11B:
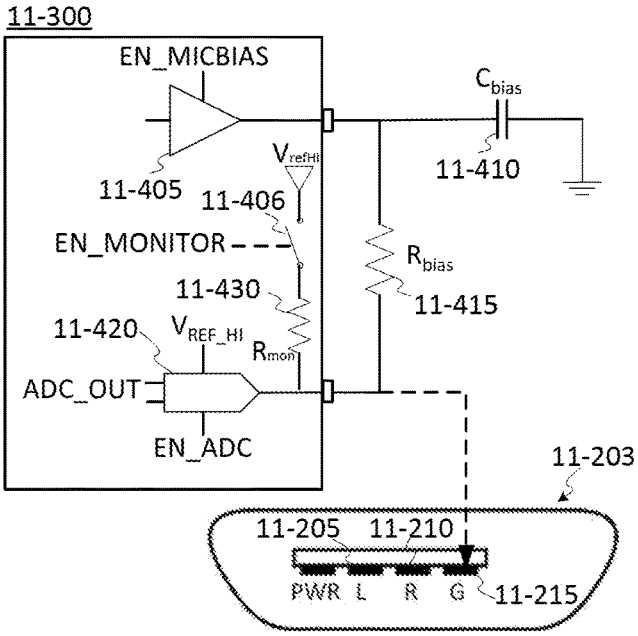

FIG. 11B illustrates a circuit diagram of a portion of a detection circuit 11-300 when a first plug 11-203, similar to the first plug 10-203 of FIG. 10A, is inserted into a receptacle of an electronic device according to an embodiment. FIG. 11B illustrates circuit elements used for initial determination of a headphone type when the first plug 11-203 is inserted into the receptacle of the electronic device.

The detection circuit 11-300 is configured to operate with headphones having parallel connectors, e.g., a micro-USB headphone, a standard USB headphone, a mini-USB headphone, a lightning thunderbolt, or the like. Like numbered reference numbers in FIG. 11B refer to similar components in FIG. 4B, and descriptions thereof are omitted in the interest of brevity.

In order to determine whether an inserted headphone is the first type headphone or the second type headphone, the detection circuit 11-300 of FIGS. 11A and 11B operates similarly to the detection circuit 4-300 of FIGS. 4A and 4B, as described above with reference to FIG. 4C. Detailed descriptions of the detection circuit 11-300 are omitted in the interest of brevity.

When the inserted headphone is initially determined as the first type headphone, the detection circuit 11-300 may perform repetitive determination of the headphone type, similarly to the detection circuit 5-300 of FIG. 5A, and detailed descriptions of the detection circuit 11-300 are omitted in the interest of brevity. In an embodiment, the detection circuit 11-300 performs a number of detection cycles to conclusively determine the type of the headphone as the first type headphone, as described above with reference to FIG. 5B.

When the inserted headphone is initially determined as the first type headphone, the detection circuit 11-300 may perform a re-determination of the headphone type to determine whether the initial determination is correct, similarly to the detection circuit 6-300 of FIGS. 6A and 6B, and detailed descriptions of the detection circuit 11-300 are omitted in the interest of brevity. In an embodiment, the detection circuit 11-300 performs one or more of detection cycles until the inserted headphone is determined as the second type, and then terminates the detection cycles, as described above with reference to FIG. 6C.

Referring back to FIG. 11A, in an embodiment, the second type headphone system 11-100B includes a plurality of switching devices 11-460, 11-465, and 11-470, each of which is used to trigger a predetermined action (e.g., increase or decrease volume, mute or unmute, etc.) Each of the switching devices 11-460, 11-465, and 11-470 may be connected between the microphone connection 11-265 and a ground connection in series with a resistor.

When the inserted headphone is initially or conclusively determined as the second type headphone, the detection circuit 11-300 may monitor an operation of one of the plurality of switching devices 11-460, 11-465, and 11-470 and identifies the operated switching device, similarly to the detection circuit 7-300 of FIG. 7A, and detailed descriptions of the detection circuit 11-300 are omitted in the interest of brevity. In an embodiment, the detection circuit 11-300 repetitively monitors an operation of one of the switching devices 11-460, 11-465, and 11-470 and identifies the operating switching device 11-460, 11-465, or 11-470, as described above with reference to FIG. 7B.

Figure 12:
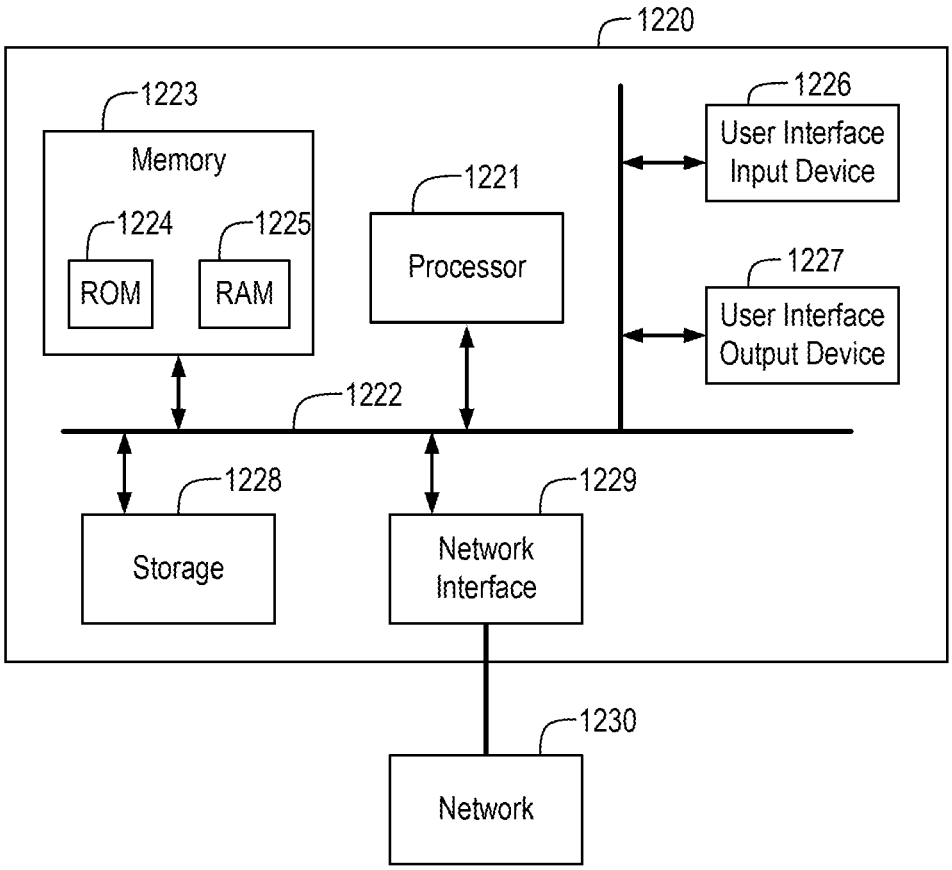
FIG. 12 illustrates a block diagram of a computer system in accordance with an embodiment.

Embodiments of the present disclosure may be implemented in a computer system or on a non-transitory computer readable medium. FIG. 12 illustrates a computer system 1220 including a processor 1221, a bus 1222, a memory 1223, and a user interface input device 1226, a user interface output device 1227, a storage 1228, and a network interface 1229 that is coupled to a network 1230. The processor 1221 may be a central processing unit (CPU) or a semiconductor device that executes processing instructions stored in the memory 1223 and/or the storage 1228. The memory 1223 and the storage 1228 may include various forms of volatile or non-volatile storage media. For example, the memory 1223 may include a ROM 1224 and a RAM 1225.

Accordingly, an embodiment of the present disclosure may be implemented as a computer implemented method or as a non-transitory computer readable medium with computer executable instructions stored thereon. In an embodiment, when executed by the processor, the computer readable instructions may perform a method according to at least one aspect of the present disclosure.

Further aspects of the present disclosure relate to one or more of the following clauses.

In an embodiment, a method includes comparing a voltage level detected by a detection circuit to a set of threshold voltages to determine a type of a headphone, determining the headphone to be a first type when a first signal travels through the first path to ground, and determining the headphone to be a second type when a second signal travels through the second path. The headphone of the second type includes a plug that has a microphone connection. The detection circuit includes a first path, a second path, and a bias capacitor.

In an embodiment, the set of threshold voltages includes first and second threshold voltages and the first and second signals are first and second currents. The headphone is determined as the first type when the detected voltage level is less than the first threshold voltage. The headphone is determined as the second type when the detected voltage level is between the first and second threshold voltages. The second signal travels through the first path and the second path to charge the bias capacitor to a reference voltage.

In an embodiment, the plug of the headphone is a serial connector.

In an embodiment, the first type is a 3-pole headphone type and the second type is a 4-pole headphone type.

In an embodiment, the plug of the headphone is a parallel connector.

In an embodiment, the plug is a micro-Universal Serial Bus (USB) connector, a standard USB connector, or a mini-USB connector.

In an embodiment, the plug is a lightning thunderbolt connector.

In an embodiment, the method further includes activating a monitor circuit and an analog-digital-converter (ADC) during an on-duration of each detection cycle when the headphone is determined to be the second type and comparing an output value of the ADC to a threshold value. The monitor circuit includes the first path and a monitor switch, and the on-duration is shorter than a period of each detection cycle.

In an embodiment, the reference voltage is a first reference voltage. The method further includes activating a micbias circuit to charge the bias capacitor to a second reference voltage when the output value of the ADC is equal to or less than the threshold value and activating the ADC to identify an operation of one of controllers included in the headphone. The micbias circuit includes a buffer and the bias capacitor. The second reference voltage has a voltage level that is substantially higher than a voltage level of the first reference voltage. The controllers are switching devices each configured to control a function in a system associated with the headphone.

In an embodiment, a method includes detecting a first voltage by a detection circuit, determining a type of a headphone to be a first type or a second type based on the detected first voltage level, and detecting a second voltage by the detection circuit, when the headphone is determined as the first type. The headphone of the second type includes a plug that has a microphone connection.

In an embodiment, the method further includes comparing the detected second voltage to a threshold voltage, repeating the detection of the second voltage when the second voltage detected by the detection circuit is less than the threshold voltage, until a number of the repetition reaches a predetermined number, and determining the headphone as the second type and terminating the detection of the second voltage level when the second voltage detected by the detection circuit is equal to or greater than the threshold value.

In an embodiment, a system includes a detection circuit including a first path, a second path, and a bias capacitor, a processor, and a non-transitory computer readable medium having computer executable instructions stored thereon which, when executed by the processor, performs comparing a voltage level detected by the detection circuit to a set of threshold voltages to determine a type of a headphone, determining the headphone to be a first type when a first signal travels through the first path to ground, and determining the headphone to be a second type when a second signal travels through the second path. The headphone of the second type includes a plug that has a microphone connection.

In an embodiment, the set of threshold voltages includes first and second threshold voltages and the first and second signals are first and second currents. The headphone is determined to be the first type when the detected voltage level is less than the first threshold voltage. The headphone is determined to be the second type when the detected voltage level is between the first and second threshold voltages. The second signal travels through the first path and the second path to charge the bias capacitor to a reference voltage.

In an embodiment, the plug of the headphone is a serial connector.

In an embodiment, the first type is a 3-pole headphone type and the second type is a 4-pole headphone type.

In an embodiment, the plug of the headphone is a parallel connector.

In an embodiment, the plug is a micro-Universal Serial Bus (USB) connector, a standard USB connector, or a mini-USB connector.

In an embodiment, the plug is a lightning thunderbolt connector.

In an embodiment, the detection circuit further includes an analog-digital-converter (ADC) configured to generate an output value corresponding to a voltage level at an input of the ADC.

In an embodiment, the detection circuit further includes a monitor circuit coupled to the input of the ADC and a buffer having an output coupled to the input of the ADC through the second path. The monitor circuit has the first path and a monitor switch. The first path has a monitor resistor and the second path has a bias resistor. A resistance value of the monitor resistor is greater than a resistance value of the bias resistor.

Aspects of the present disclosure have been described in conjunction with the specific embodiments thereof that are proposed as examples. Numerous alternatives, modifications, and variations to the embodiments as set forth herein may be made without departing from the scope of the claims set forth below. Accordingly, embodiments as set forth herein are intended to be illustrative and not limiting.

What is claimed is:

1. A method comprising:

comparing a voltage level detected by a detection circuit to a set of threshold voltages to determine a type of a headphone, the detection circuit including a first path, a second path, and a bias capacitor;

determining the headphone to be a first type when a first signal travels through the first path to ground; and determining the headphone to be a second type when a second signal travels through the second path, the headphone of the second type including a plug that has a microphone connection.

2. The method of claim 1, wherein the set of threshold voltages includes first and second threshold voltages, wherein the first and second signals are first and second currents, wherein the headphone is determined as the first type when the detected voltage level is less than the first threshold voltage, wherein the headphone is determined as the second type when the detected voltage level is between the first and second threshold voltages, and wherein the second signal travels through the first path and the second path to charge the bias capacitor to a reference voltage.

3. The method of claim 1, wherein the plug of the headphone is a serial connector.

4. The method of claim 3, wherein the first type is a 3-pole headphone type and the second type is a 4-pole headphone type.

5. The method of claim 1, wherein the plug of the headphone is a parallel connector.

6. The method of claim 5, wherein the plug is a micro-Universal Serial Bus (USB) connector, a standard USB connector, or a mini-USB connector.

7. The method of claim 5, wherein the plug is a lightning thunderbolt connector.

8. The method of claim 1, further comprising:

activating a monitor circuit and an analog-digital-converter (ADC) during an on-duration of each detection cycle when the headphone is determined to be the second type, the monitor circuit including the first path and a monitor switch, the on-duration being shorter than a period of each detection cycle; and comparing an output value of the ADC to a threshold value.

9. The method of claim 8, wherein the second signal travels through the first path and the second path to charge the bias capacitor to a reference voltage, and the reference voltage is a first reference voltage, the method further comprising:

activating a micbias circuit to charge the bias capacitor to a second reference voltage when the output value of the ADC is equal to or less than the threshold value, the micbias circuit including a buffer, the second reference voltage having a voltage level that is substantially higher than a voltage level of the first reference voltage; and activating the ADC to identify an operation of one of controllers included in the headphone, and wherein the controllers are switching devices each configured to control a function in a system associated with the headphone.

10. A method comprising:

detecting a first voltage by a detection circuit;

determining a type of a headphone to be a first type or a second type based on the detected first voltage level, the headphone of the second type including a plug that has a microphone connection;

detecting a second voltage by the detection circuit, when the headphone is determined as the first type;

comparing the detected second voltage to a threshold voltage; and repeating the detection of the second voltage when the second voltage detected by the detection circuit is less than the threshold voltage, until a number of the repetition reaches a predetermined number, wherein repeating the detection of the second voltage comprises keeping a micbias circuit deactivated.

11. The method of claim 10, wherein the micbias circuit includes a buffer, the method further comprising:

determining the headphone as the second type and terminating the detection of the second voltage level when the second voltage detected by the detection circuit is equal to or greater than the threshold value.

12. A system comprising:

a detection circuit including a first path, a second path, and a bias capacitor;

a processor; and a non-transitory computer readable medium having computer executable instructions stored thereon which, when executed by the processor, performs the following method:

comparing a voltage level detected by the detection circuit to a set of threshold voltages to determine a type of a headphone;

determining the headphone to be a first type when a first signal travels through the first path to ground; and determining the headphone to be a second type when a second signal travels through the second path, the headphone of the second type including a plug that has a microphone connection, wherein the second signal travels through the first path and the second path to charge the bias capacitor to a reference voltage.

13. The system of claim 12, wherein the set of threshold voltages includes first and second threshold voltages, wherein the first and second signals are first and second currents, wherein the headphone is determined to be the first type when the detected voltage level is less than the first threshold voltage, and wherein the headphone is determined to be the second type when the detected voltage level is between the first and second threshold voltages.

14. The system of claim 12, wherein the plug of the headphone is a serial connector.

15. The system of claim 14, wherein the first type is a 3-pole headphone type and the second type is a 4-pole headphone type.

16. The system of claim 12, wherein the plug of the headphone is a parallel connector.

17. The system of claim 16, wherein the plug is a micro-Universal Serial Bus (USB) connector, a standard USB connector, or a mini-USB connector.

18. The system of claim 16, wherein the plug is a lightning thunderbolt connector.

19. The system of claim 12, wherein the detection circuit further includes an analog-digital-converter (ADC) configured to generate an output value corresponding to a voltage level at an input of the ADC.

20. The system of claim 19, wherein the detection circuit further includes:

a monitor circuit coupled to the input of the ADC, the monitor circuit having the first path and a monitor switch;

a buffer having an output coupled to the input of the ADC through the second path, and wherein the first path has a monitor resistor and the second path has a bias resistor, a resistance value of the monitor resistor being greater than a resistance value of the bias resistor.

* * * * *